United States Patent [19]

Baltes

[11] 4,180,919

[45] Jan. 1, 1980

[54] METHOD FOR DRYING LAUNDRY, AND A DRYING CABINET FOR CARRYING OUT SUCH METHOD

[76] Inventor: Hans Baltes, Heideweg 21a, 5841 Dortmund-Holzen, Fed. Rep. of Germany

[21] Appl. No.: 842,493

[22] Filed: Oct. 17, 1977

[30] Foreign Application Priority Data

| | | | |
|---|---|---|---|
| Oct. 18, 1976 | [DE] | Fed. Rep. of Germany | 2646903 |
| Jan. 7, 1977 | [DE] | Fed. Rep. of Germany | 2700493 |
| Feb. 8, 1977 | [DE] | Fed. Rep. of Germany | 2705116 |

[51] Int. Cl.[2] ..... F26B 3/04

[52] U.S. Cl. ..... 34/23; 34/34; 34/35; 34/86; 34/151

[58] Field of Search ..... 34/35, 27, 29, 32, 86, 34/55, 23, 151, 76, 34, 77, 232, 233; 312/236

[56] References Cited

U.S. PATENT DOCUMENTS

| | | | |
|---|---|---|---|
| 1,273,598 | 7/1918 | Flanagan | 34/151 |
| 3,491,458 | 1/1970 | Elders et al. | 34/55 |
| 3,859,735 | 1/1975 | Katterjohn, Jr. | 34/86 |
| 4,028,817 | 6/1977 | Winstel | 34/86 |
| 4,065,253 | 12/1977 | Bullock | 34/86 |
| 4,095,349 | 6/1978 | Parker | 34/86 |

*Primary Examiner*—John J. Camby
*Assistant Examiner*—Larry I. Schwartz
*Attorney, Agent, or Firm*—Fitch, Even & Tabin

[57] ABSTRACT

The present invention provides a method of drying flat material, particularly laundry or washing, within a drying cabinet wherein air is aspirated from the exterior, compressed and heated, passes through the drying cabinet with the material disposed therein, and thereafter exhausted, with the drying air flowing against said material from the one side of the interior of said cabinet while being directed against the edges of said material, and with the air being discharged at the opposite side of the interior of said cabinet, whereupon the drying air is cooled in a condenser and, finally, either exhausted from the cabinet or re-used for drying after having been heated again, as well as a drying cabinet for carrying out such method and including improved suspension means of the rods or bars from which the laundry is suspended.

6 Claims, 10 Drawing Figures

Fig.1
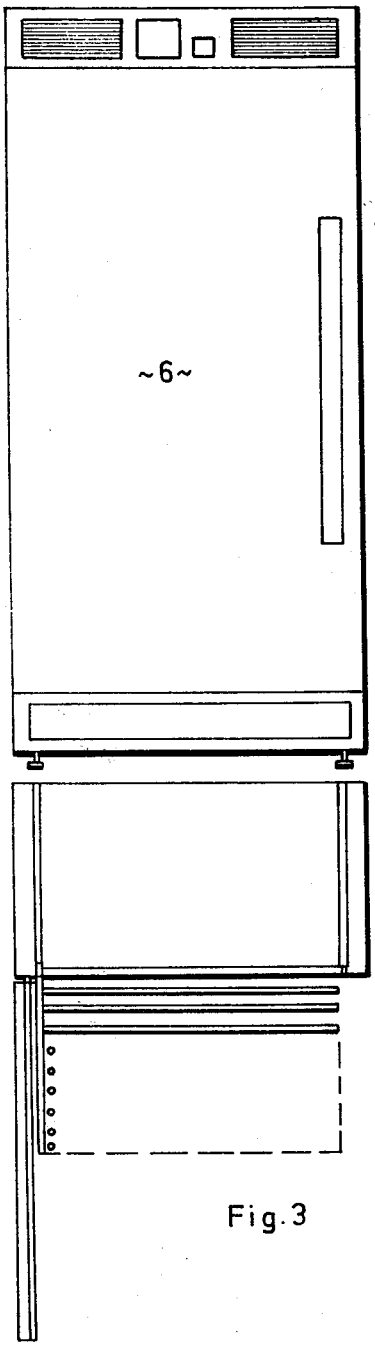
Fig.2
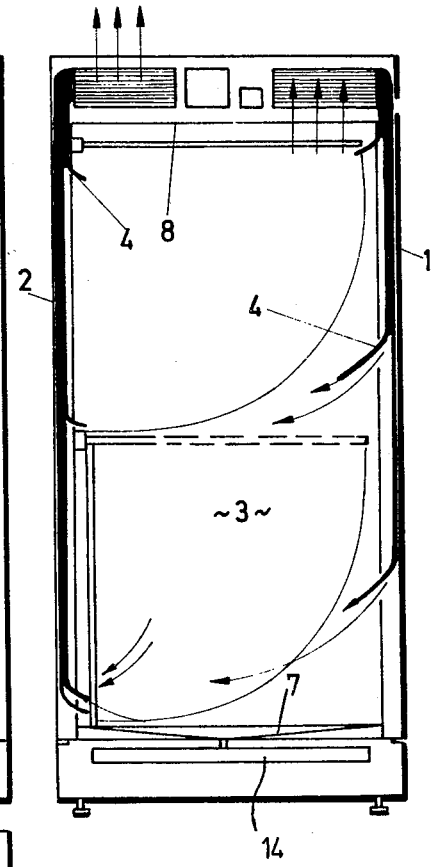
Fig.3

METHOD FOR DRYING LAUNDRY, AND A DRYING CABINET FOR CARRYING OUT SUCH METHOD

The present invention relates to a method of drying flat material, particularly laundry or washing, within a drying cabinet wherein air is aspirated from the exterior, compressed and heated, passed through the drying cabinet with the material disposed therein, and thereafter exhausted, with the drying air flowing against said material from the one side of the interior of said cabinet while being directed against the edges of said material, and with the air being discharged at the opposite side of the interior of said cabinet, as well as a drying cabinet comprising a charging door, an air suction opening, a blower (fan), a heating device for the drying air and bars or rods for suspending the material, said bars extending from a first wall of said cabinet to the second, opposite wall thereof, wherein air guiding (conduit) means are disposed in said first cabinet wall to provide for uniform flow of the drying air from said first cabinet wall into the interior of said cabinet, and wherein said second cabinet wall includes in its inner lower portion an exhaust port for exhausting said drying air from the interior of said cabinet.

Drying methods and drying cabinets of this type are already known from the laid-open German patent applications Nos. 2,149,873 and 2,125,369. The drying cabinets of these applications enjoyed an extraordinarily high success, but they suffer from the minor drawback that the laundry wich is suspended adjacent the second wall including the air exhaust from the interior in the upper portion thereof, requires an extended drying period such that the total drying period is unnecessarily increased; that the exhausted air stream is very hot while taking along the absorbed water volume in an uncondensed state, that energy consumption is not as low as practically possible, and that the suspending device for the laundry is complicate in handling and resilient under high loads.

Besides, it is disadvantageous for unexperienced users that they do not yet know the exact drying period of their laundry, by skill, such that they may feel induced to adjust too long a period of drying. Such exessive drying periods, however, are disadvantageous because this might result in unnecessary energy consumption, whereas, on the other hand, excessively dried laundry may tend to become hard and rigid.

Accordingly, it is the object of the present invention to provide a method for the drying of flat material, especially of laundry or washing, as well as an apparatus for carrying out such method, which do no longer suffer from the above-discussed drawbacks, wherein uniform drying is obtained across the full space of the drying compartment, and which do not produce any unnecessary environmental upsetting by moisture any longer.

In particular, the drying cabinet according to the invention should be of simple structure, adapted to safely avoid excessive drying of the laundry, of more compact construction, and suitable to dry a relatively greater amount of laundry than the conventional laundry drying cabinets or closets. Furthermore, the apparatus should allow for condensation of the moisture extracted from the laundry.

Briefly, it is therefore another object of the present invention to provide a method for the drying of laundry as well as a drying apparatus which do not produce any environmental pollution or upsetting, and wherein the drying apparatus, furthermore, requires only a minimum amount of energy and provides for highly effective drying.

According to the invention, this object is solved in that the drying air flowing across the material to be dried is first passed from the laundry to a condenser for the condensation of at least part of the water entrained by the air stream, and thereafter exhausted, with said condenser preferably having an air flow passing therethrough, whereby the air is sucked in from the exterior of the apparatus and then further heated in a heater for use as drying air.

Alternatively, the air may be passed to a blower (fan) downstream of the condenser, and subsequently to a heater, to thereafter flow back to the laundry.

For avoiding excessive drying or over-drying of the laundry which would result in a hard and rigid "feel" of the dried pieces of laundry, heating of the drying air may be terminated at a given point of time in advance of the end of the drying period, and said switch-off period may be in the order of about 15 minutes.

Another method of terminating the drying operation as soon as the laundry has been dried completely, comprises measuring the temperature or humidity of the drying air to be exhausted and switching off the heating means or terminating the drying operation when a given temperature is reached, or when a given temperature increase per unit of time is detected, or when a predetermined low degree of humidity is reached.

Advantageously, the drying cabinet according to the invention is characterized, in that the second cabinet wall opposite to the first wall including the slots (louvers) for the supply of air, has in its upper portion and, optionally, also in its center portion one or more slot-shaped discharge or exhaust openings for the drying air with the greater cross-sectional areas of the openings for exhausting the drying air from the interior space being disposed in the lower portion. Furthermore, the drying cabinet includes a condenser for cooling the drying air after the adsorbtion of moisture, and suspending means for the laundry wherein a supporting surface having a width equal to the spacing between the bars is present in said suspending means between a stationary and a movable portion, when the bars for suspending the laundry are folded upwards.

Quite generally, this suspending means may be used also for the suspension of laundry, sheet-like material and other foldable articles externally of laundry drying cabinets.

Furthermore and preferably, in such drying cabinet the bars adapted to be individually folded down relative to their mounting bracket may have their free ends provided with protective caps of plastics material of high sliding capacity, or with rollers, and the cabinet wall not supporting the bracket of the bars may provided with a groove in which the protective caps or said rollers slide or cam, respectively, when the bars are retracted or extended into the cabinet.

Also, according to the invention the improved pivoting and latching or locking of the bars is obtained in that the periphery of an anchoring or tie element mounted to a wall is of circular configuration with the exception of a peripheral portion at the upper side thereof, with said element having at said upper side a flat portion and a projection joined thereto, with the front face of said projection which is directed away from the bars or articles, extending vertically; that the ends of the bars or articles adjacent the anchoring element have attached thereto at least one end element having an aperture through which said anchoring element passes; that the upper region of said aperture has a configuration complementary to that of the upper portion of said anchoring element, such that both faces are adapted to be fitted or nested together without clearance; and that said element has joined to its upper portion a pair of parallel legs with the spacing between said legs corresponding to the diameter of said element, and said legs having an inner, straight surface extending perpendicularly to the extension of the bars or of said article, with the length of said surface being greater than the height of the front of said anchoring element.

In the following, an exemplary embodiment of the invention is explained in greater detail by referring to the enclosed drawings, wherein:

FIG. 1 shows a front elevational view of the drying cabinet;

FIG. 2 shows a sectional view of the drying cabinet of FIG. 1;

FIG. 3 is a plan view of the drying cabinet with the bar grid extended;

Figure 4:
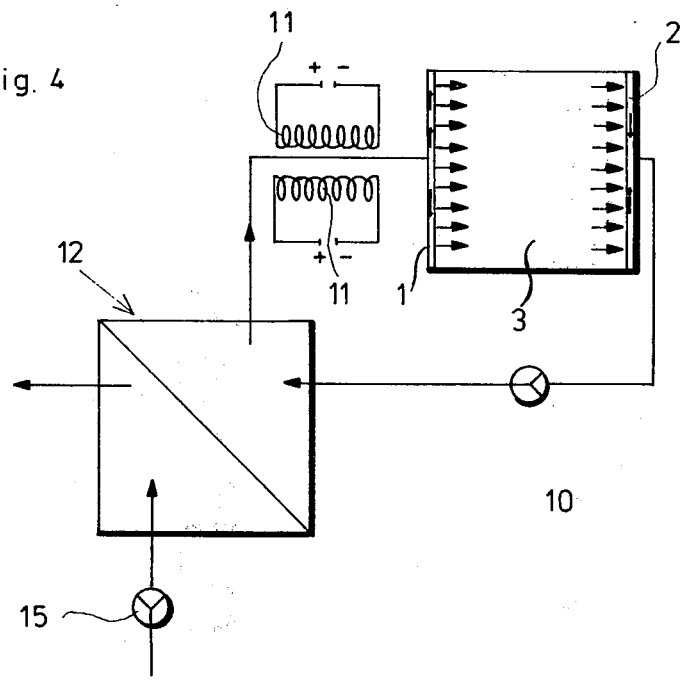
FIG. 4 shows a flow diagram of the air following within a drying cabinet according to the invention, wherein condensation is effected by a cold air stream or a water stream.

As shown in FIGS. 1 and 2, the present drying cabinet comprises sidewalls 1 and 2 of double-wall construction, in which structure air flows with uniform distribution across the wall from slots 4 formed in sidewall 1, so as to flow into the interior space 3 and to be exhausted through slots 4 provided in sidewall 2. Further, the interior space or compartment includes a rear wall 5 and a door 6, as well as a bottom plate 7 and an upper cover plate 8.

Cabinet sidewall 2 has in its lower portion at least one large slot 4 and at least one small slot 4 in the upper portion thereof; however, intermediate slots 4 may be provided between these slots with the number of such slots increasing towards the bottom. It must be seen to it that air is discharged from the interior space in non-uniform fashion with the major portion of the air being exhausted in the lower part. In this way, it is obtained that a primary flow from above to below is formed and the pieces of laundry are always neatly and vertically suspended, such that the transverse flow component when impinging against the edges of the articles or laundry, is prevented from blowing such articles back or to the rear thereby to avoid blocking of the air flow path between the articles of laundry. However, the provision of slot 4 in the upper part of sidewall 2 results in eliminating the otherwise existing space of insufficient air flow. In a further embodiment of the invention, the width of slots 4 is therefore made variable, or flow impeding baffles are mounted at the rear of these slots, such that the passage of air through the slots 4 provided in the upper portion and, optionally, in the center portion, is kept small.

Bars or rods 9 for suspending articles of laundry or the like extended from cabinet side wall 1 to sidewall 2, said rods 9 or other suitable suspending elements being arranged in three levels and, as shown in FIG. 3, adapted to be moved out from the cabinet, of adapted to be folded down individually or as a unit.

A removable drip trough 14 may be provided below or above the bottom plate 7.

Above the upper cover plate 8 and below the bottom plate 7, there are provided at least one blower (fan) 10, heater elements 11 as well as the control elements and the suction and exhaust ports for the drying air. In this construction, suitable air conduit or baffle means serve to guide the air through blower 10 and heater elements 11 into sidewall 1 and from sidewall 2 into a condenser or heat exchanger 12. The aforementioned components may be formed as insertable modules, and these components may include the measuring devices for detecting humidity or air temperature, separately or in dependency of a timer unit, as well as the cut-off means to stop the air passage, or the heater elements.

Figure 5:
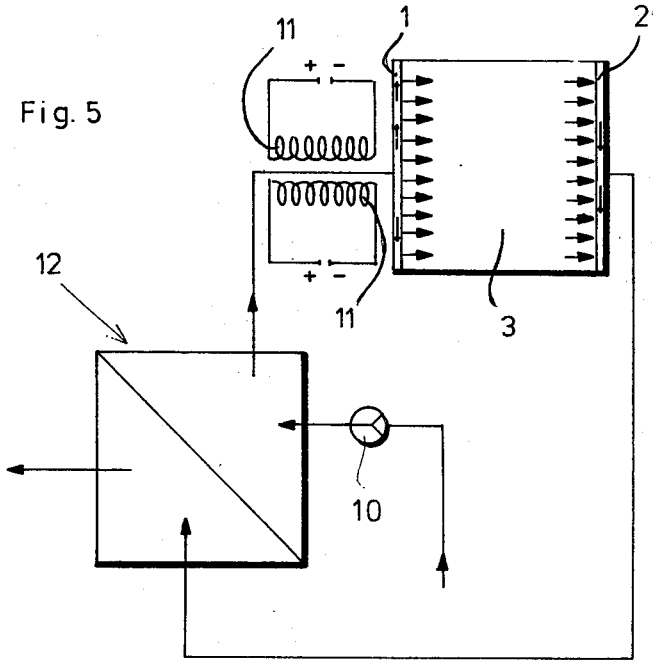
FIG. 5 shows a flow diagram in which the exhausted air stream heats the entering air stream.

As shown in FIG. 5, the inlet air aspirated into the cabinet is brought into thermal contact with the exhaust air from the drying compartment within a condenser or heat exchanger 12, such that the temperature of the inlet air is increased, while the temperature of the exhaust air is substantially reduced. For example, a nest of tubes may serve as the heat exchanger, with the inlet air flowing through the tubes and the exhaust air contacting the outer sides of the tubes, whereby part of the moisture is condensed and the exhaust air is thereafter blown out in a substantially cooled state. The inlet air is first passed to the blower (fan), then to the condenser, then to the heater and thereafter to the air conducting sidewall 1. FIG. 5 shows schematically a corresponding air conduit system including a condenser or heat exchanger 12. As the entering air is already preheated, substantial savings in energy may be realized. In particular, the exhausted air is greatly cooled so as to be prevented from annoyingly heating the surroundings of the drying cabinet. Below the heat exchanger 12, a (not illustrated) drip trough is positioned in which condensed water is collected. The drip trough may be adapted to be removed separately, or it may be connected to the drip trough 14 in the lower part of the cabinet by a pipeline, or provided with continuous draining means.

According to FIG. 4, the drying air stream may be passed also in a closed circulation loop so as to flow through the heat exchanger or condenser 12 upon being exhausted from the drying compartment, whereby the air is cooled and the entrained moisture is condensed. The condensed water flows into the abovementioned drip trough.

From the outlet of the condenser 12, the drying air flow passes through a blower 10, whereupon the air is heated within a heater 11 to the temperature required for drying purposes, i.e. to about 80° to 120° C.

When such closed circuit is used, the condenser 12, as shown in FIG. 4, may have passing therethrough a cold air stream which is sucked in by a blower or fan 15 from the surroundings of the drying apparatus, and which is released to the environment after having passed through the condenser. However, the condenser 12 may have passing therethrough also a water flow from a water mains.

In view of the fact that, for instance, odourous substances or the like may concentrate within the closed drying air circulation path, in the case of using a cold air cooling system the wall of the condenser, according to the invention, may be interrupted in some places such that some air exchange takes places between the cold air stream and the drying air stream. Owing to the resulting direct heat transfer within the condenser, the heat transfer surface area may be further reduced.

Figure 6:
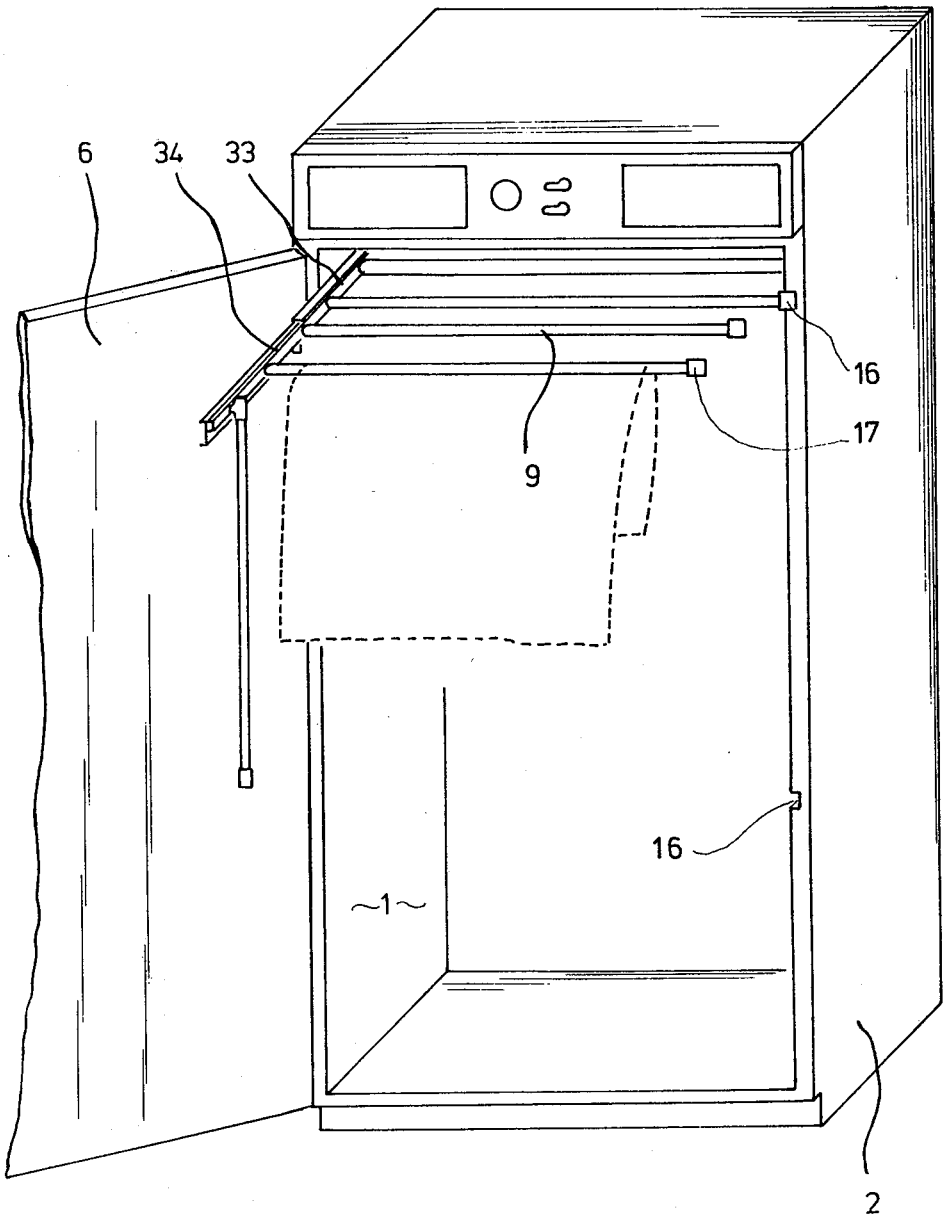
FIG. 6 is a perspective view of the present drying cabinet including an extensible mounting bracket for the bars, with the free end of the bracket being removable within a groove in the oppositing wall.
Figure 7:
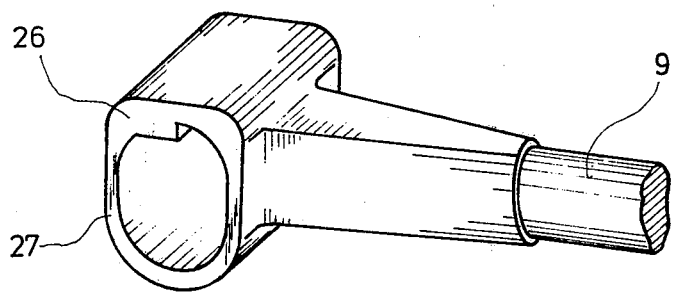
FIG. 7 is a perspective view of one of the holding or retainer elements with the bar for suspending the laundry being inserted thereinto.
Figure 8:
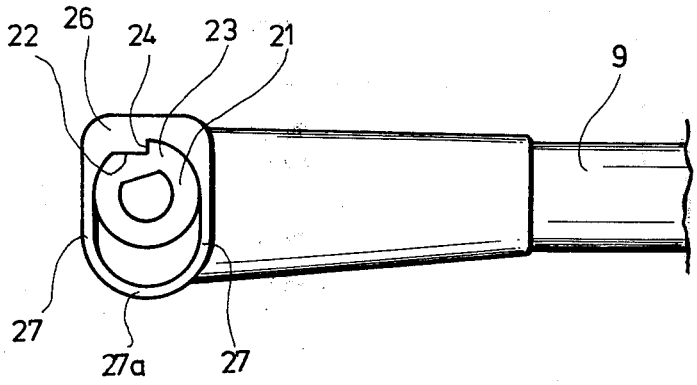
FIG. 8 is a sectional view of a holding or retainer element being placed upon an anchoring or tie element.
Figure 9:
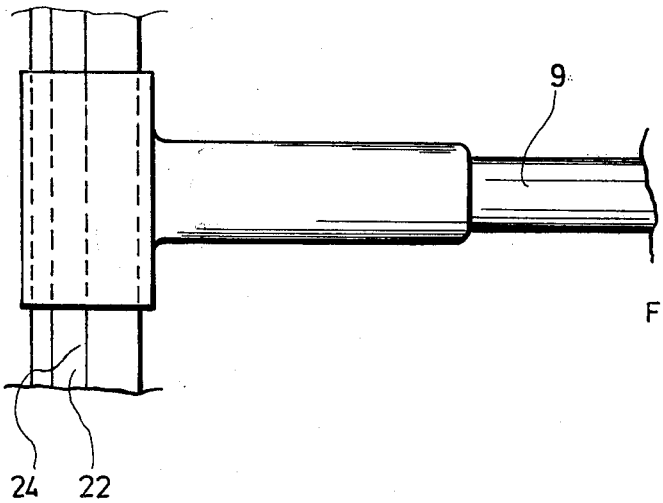
FIG. 9 is a plan view of the mounting bracket with the bars inserted.

As shown in FIG. 6, a telescoping mounting bracket for the bars or rods 9 is positioned on cabinet sidewall 1. The cabinet sidewall 2 opposing said sidewall 1 has formed therein a groove 16 in which the free ends of the bars 9 are guided during withdrawal of the bars and when the bars are inserted again. In order to provide for better guidance of the bars, the free ends thereof have placed thereon protective caps 17 consisting of a highly slidable plastics material, such as PVC or PTFE. In a further modification of the invention, the protective caps 17 may be replaced by rollers whereby insertion is facilitated when greater loads are suspended from the rods or bars 9.

Figure 10:
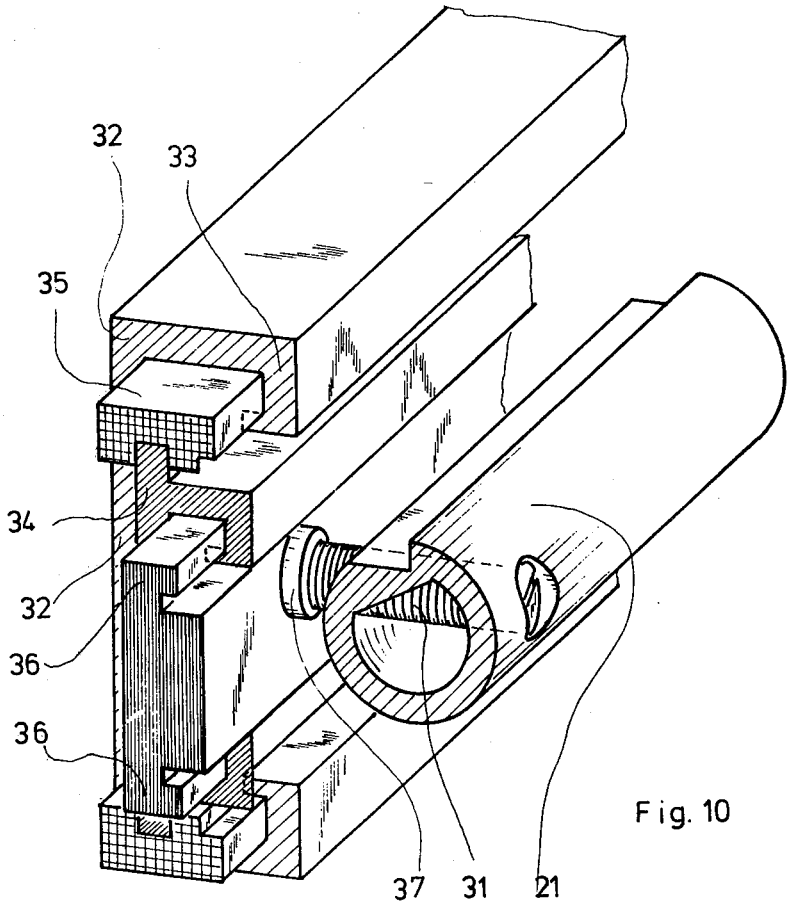
FIG. 10 is a perspective sectional view of a telescoping strut according to the invention for supporting an anchoring element.

According to FIG. 10, the mounting bracket for the rods 9 comprises an outer section (profile) 23 being secured to sidewall 1 or inserted into a groove thereof, and in which another section 34 is slidably guided. The latter section, in turn, has attached thereto an anchoring or tie element 21 for the rods 9.

In order to provide for improved support of the anchoring or tie element 21, the rearmost rod 9 is securely mounted thereto, and the guides are of so short a length that the rearmost rod cannot be withdraw from the cabinet, but rather is constantly retained within groove 16 with the free end thereof.

The user of a drying cabinet according to the invention would first load the rearmost rod 9 with articles, to thereafter fold up the rod in front of the rearmost rod and hang articles from such rod and continue in this manner until all rods are loaded, whereupon the rods or bars will be slid into the cabinet. Hereby, it is inessential whether the rods are each placed into the cabinet directly after having been loaded, or whether the fully loaded grid is slid into the cabinet only.

The dried laundry may then be removed by reversing the above operation, unless the direct placing onto, and removal from, the horizontally extending rods is preferred.

As shown in FIGS. 7 to 10, the present mounting bracket for the suspending rods or bars for laundry and other downwardly foldable articles generally comprises an anchoring or tie element 21 having a length corresponding to an integral multiple of end elements 26 into which the rods 9 are inserted, if required. The end elements 26 have a specific width in the range of some centimeters, and the width thereof corresponds to the spacing between a pair of rods, such that the width thereof is determined by thermodynamic considerations.

Although the present mounting bracket is suitable particularly for suspending rods or bars for the drying of laundry, however, in the industrial field this structure may be used preferably also for the drying of any other material. For example, each of said end elements may be employed for supporting plates, such that the mounting bracket may be used also for fold-down shelves, table tops, supports or braces, doors for use in furniture and the like. This use in only restricted by the requirement that anchoring or tie elements 21 according to the invention must be employed and properly fastened; but regardless of such requirement, any desired articles may be securely held or suspended even in the case of high loads and limited available space.

The present mounting bracket and the suspending device formed thereby, respectively, may be employed both in drying cabinets and also as a wall fitting means, whereby the rods or bars are folded down in their inactive state. In such state, the rods or bars hang down closely adjacent the wall such that they do not occupy any space e.g. in bathrooms, kitchens or even balconies. In this manner, even laundry articles of great length may be suspended in drying cabinets if, for example, the lower rows of bars or rods are folded down and not loaded. It is obvious to the expert that there is obtained the advantage of the particularly ready loading even if this structure is used as a wall fitting.

The anchoring or tie element 21 has both ends thereof either connected to a base plate (not shown) which may be fastened by screws to walls, pieces of furniture and the like, or the connection is made to the exterior plate of a telescoping strut such that the thus formed suspending device may be completely withdrawn from a drying cabinet. In the inserted state, the rods then extend from one sidewall to the other.

In detail, the anchoring or tie element has major part of its circumference formed with circular configuration, and only the upper side of element 21 is provided with a flat portion 22 which joins a projection 23 at the end adjacent the rod(s), which projection, in turn, has a front face 24 at its side opposite from the rods. For reasons of weight reduction, the anchoring or tie element 21 may be hollow.

The end elements 26 of rods 9, or plates, preferably of circular configuration, are each formed in the lower portions thereof with an aperture the upper part of which is shaped complementary to the upper portion of said anchoring or tie elements 21, such that the two mating surfaces are adapted to be nested or slid into each other without any clearance. At the side of the anchoring or tie elements 21, end elements 26 include a pair of legs 27 each extending perpendicularly to the rods in parallel with each other, and the free height of which is at least as great as the height of the front faces 24. Thus, the end elements 26 may be lifted relative to the anchoring element 21 by at least the height of the front faces 24, whereby the edges of projections 23 are released from each other and rods 9 may be swung into a vertical position.

For reasons of strength, the legs have their lower sides interconnected by an integral yoke **27*a*** such that a closed annular structure of high strength is formed; at least, however, such lower ends are angularly bent inwards.

The type of attachment of the anchoring elements 21 to base plates or telescoping struts, as explained above, is left to the expert's discretion and need not be described in any greater detail at this place. Studs or, as shown in FIG. 10, screws or bolts 31 may be used.

According to FIG. 10, the anchoring elements 21 may be connected to a telescoping strut of particularly advantageous construction, by means of screws 31 or studs. Telescoping struts of this type may be employed both in drying cabinets of the above-outlined type, and in any desired pieces of furniture, such as for drawers of writing desks, tables and closets, as well as for wire baskets in dish washing machines, refrigerators and the like. Accordingly, the use of these elements is not limited to drying cabinets; rather, they may be used in any place where conventional telescoping struts are employed and subject to particularly high demands with respect to easy slidability, extensibility and, especially, strength to bending or twisting.

As shown in FIG. 10, the telescoping struts according to the invention comprise a U-shaped section 32 stationarly mounted to furniture or to the cabinet and having the outer flanges thereof continuing into inwardly directed hook-shaped flanges 33, with a U-section 31 of identical configuration being positioned within section 32, and wherein a fitting piece 35 is disposed in the area of the flanges of section 32 while a further fitting piece 36 or a plurality of corresponding fitting pieces are arranged in the flange area of section 34, said fitting pieces being formed of plastics material or of a suitable material having self-lubricating properties. Fitting pieces 35 are secured to the outer flanges of section 34, and fitting pieces 36 are secured to said studs or screws 31 of other suitable fastening elements.

For improved attachment of fitting piece 35, the center portion of section 34 may have both sides thereof extended beyond the outer flanges, and between the fitting pieces 36 disposed in upper and lower positions, respectively, there may be present a bridge member integrally connecting said fitting pieces and having an anchoring or tie element 37 formed therein during manufacture thereof or at a later point of time. This anchoring element 37 then allows the insertion of the studs or the threaded engagement of the screws 31 or of other connecting means. The modern plastics materials and other, properly chosen materials show minimum coefficients of friction relative to smooth surfaces, e.g. of steel or aluminum sections or profiles, such that extension and retraction of the telescoping strut requires minimum effort even under high pressure or compressive loads.

The use of fitting pieces in the place of the conventional ball guide means provides absolute freedom from backlash, such that torsion or bending (deflection) is thereby avoided.

What we claim is:

1. A method of drying flat material, such as laundry, hanging vertically in an interior of a cabinet, flowing heated air from one side of the interior of the cabinet and against the edges of said hanging material, exhausting a major portion of said flowing heated air in said cabinet interior from the lower portion at the opposite side of the interior of said cabinet and exhausting a smaller portion of said drying air from the upper portion at the opposite side of the interior of said cabinet, directing the exhausted warm air from said cabinet interior to a heat exchanger for exchanging part of its thermal energy within said heat exchanger to provide preheated air, heating the preheated air to a temperature for drying, and then flowing the heated drying air to said first side of said cabinet flowing into the interior thereof.

2. The method according to claims 1, characterized by terminating the heating of the drying air at a given point of time prior to the end of the drying operation.

3. A method in accordance with claim 1 including the step of recirculating said drying air in a closed loop with water being condensed from said exhausted warm air prior to being further heated and returned to said first side of said cabinet.

4. A method in accordance with claim 1 including the further steps of condensing in said heat exchanger some of the moisture entrained by said warm air exhausting from said cabinet and discharging to ambient the cooled and dried air, taking in fresh air into said heat exchanger for preheating in said heat exchanger.

5. A method in accordance with claim 1 including the step of measuring a condition of the drying air and terminating the drying operation for a load of material after measuring a predetermined condition for said drying air.

6. A method of drying flat material hanging downwardly in a cabinet wherein heated air is discharged from a first vertical side wall into the interior space of the cabinet for exhaust from an opposite vertical side wall of the cabinet, said method comprising the steps of:

introducing the heated drying air from said first wall against edges of the vertically hanging flat material, flowing the air in said interior space with a primary flow from above to below and transversely from said first side wall toward said second side wall for exhausting at a lower portion of said second wall, causing a minor flow of air transversely across and for exhausting at the upper portion of the cabinet, directing the heated moist air exhausting from the interior of said cabinet to a heat exchanger, passing inlet fresh air into said heat exchanger for being heated by said heated exhausting air from said cabinet interior to provide preheated air, and passing the preheated air to a heater for further heating the drying air, and then passing the drying air to said first cabinet wall for discharge into the cabinet interior.

* * * * *